US005249916A

United States Patent [19]

Portrait et al.

[11] Patent Number: 5,249,916

[45] Date of Patent: Oct. 5, 1993

[54] CAM ASSEMBLY AND FEEDER MECHANISM FOR USE IN A PACKAGING MACHINE

[75] Inventors: Pascal Portrait, Nuret le Ferron; Michel Lamamy, Les Boers, both of France

[73] Assignee: The Mead Corporation, Dayton, Ohio

[21] Appl. No.: 887,549

[22] Filed: May 8, 1992

[30] Foreign Application Priority Data

Jan. 29, 1992 [GB] United Kingdom ..... 9108774

[51] Int. Cl.[5] ..... B65G 59/00

[52] U.S. Cl. ..... 414/798.9; 53/567; 74/55

[58] Field of Search ..... 53/458, 566, 567; 493/315, 317, 318, 316; 271/95, 99; 414/789.9; 221/211; 74/50, 55, 567

[56] References Cited

U.S. PATENT DOCUMENTS

| | | | |
|---|---|---|---|
| 498,552 | 5/1893 | Hunt | 74/63 |
| 1,979,195 | 7/1933 | Salomon | 74/55 |
| 2,494,186 | 1/1950 | Magnusson | 271/98 |
| 3,181,860 | 5/1965 | Liebenow et al. | 271/102 |
| 3,536,570 | 10/1970 | Holstein | 156/566 |
| 3,575,409 | 4/1971 | Calvert | 271/102 |
| 3,835,717 | 9/1974 | Rudolph | 74/40 |
| 3,887,177 | 6/1975 | Farfaglia et al. | 271/12 |
| 3,994,490 | 11/1976 | Smiltneck | 271/136 |
| 4,069,724 | 1/1978 | Sobotta | 74/569 |
| 4,154,438 | 5/1979 | Seragnoli | 271/12 |
| 4,596,545 | 6/1986 | Greenwell | 493/318 |
| 4,605,393 | 8/1986 | Krieger et al. | 271/95 |
| 4,625,575 | 12/1986 | Le Bras | 271/102 |
| 5,019,029 | 5/1991 | Calvert | 493/315 |

FOREIGN PATENT DOCUMENTS 2547132 5/1977 Fed. Rep. of Germany .

OTHER PUBLICATIONS

S. P. Garrison and E. B. Kroeker, "Paper Feed Apparatus", IBM Technical Disclosure Bulletin, vol. 22, No. 4, (Sep. 1979).

*Primary Examiner*—David H. Bollinger
*Assistant Examiner*—Carol Wallace
*Attorney, Agent, or Firm*—Tsugihiko Suzuki

[57] ABSTRACT

A cam assembly comprises a cam plate having formed therein deeper and shallower cam tracks, a first cam follower for movement within the deeper cam track, a second cam follower for movement within the deeper and shallower cam tracks, and a drive mechanism for moving the first and second cam followers with respect to the cam tracks. The cam followers are connected to an article pick-up member. The deeper cam track includes portions engaged sequentially by the first cam follower, and the shallower cam track includes portions engaged sequentially by the second cam follower. The article pick-up member is caused to move to an outwardly extended position and to an inwardly retracted position respectively, relative to the central axis of the cam plate. The article pick-up member is also caused to move through both a like-rotational and a counter-rotational path with regard to the direction of rotation of the drive mechanism.

4 Claims, 10 Drawing Sheets

FIG. 3. POSITION A

FIG. 4. POSITION B

FIG. 5. POSITION C

FIG. 6. POSITION D

FIG. 7. POSITION E

FIG. 8. POSITION F

FIG. 9. POSITION G

CAM ASSEMBLY AND FEEDER MECHANISM FOR USE IN A PACKAGING MACHINE

The invention relates to a cam assembly and feeder mechanism for use in a paperboard carton packaging machine where the mechanism performs the function of withdrawing carton blanks sequentially from a hopper, partially or fully erecting each carton blank and moving it to a point of loading with articles such as bottles or cans.

Known cam assemblies and feeder mechanisms are disclosed in EPA182593 which describes a cam assembly that enables movement of a carton pick-up means along a rotary path. The pick-up means moves between an outwardly extended position where it engages a carton blank and an inwardly retracted position. The known cam assembly incorporates a cam plate which has a continuous cam track joined to a second cam track both of which are defined in the plate such that a pair of cam followers can be driven round the first continuous cam track and only one of said cam followers can be driven round said second cam track. Each of the cam tracks and cam followers are distinguishable since according to EPA182593 one of the cam tracks is relatively deeper than the other and both cam followers are thus able to move within this deeper cam track. The other cam track is relatively shallower and since the cam followers are similarly of different lengths then only the shorter of the two cam followers is able to move within the second shallower cam track. By providing a cam assembly incorporating the two distinct cam tracks and cam followers as just described an article pick-up means, such as a vacuum cup, interconnected with the cam by connecting rods is able to be moved along a generally eccentric but continuous locus about a rotary shaft. EPA182593 thus provides smooth rotational movement of the carton in the feeder mechanism which provides for increased speed in the packaging machine. However, movement of the pick-up means is in a uniform rotational direction, clockwise or anticlockwise, about a central axis and it does not allow for partial counter rotation during the cycle of said rotation.

According to one aspect of the invention there is provided a cam assembly for incorporation in an article feeder mechanism which assembly comprises a cam plate having formed therein a first continuous cam track and a second relatively shallower cam track, cam track follower means including a first follower for relative movement within said first continuous track and a second follower for relative movement within the first and second cam tracks, drive means for moving said cam track followers with respect to said cam tracks, said cam track follower means being mounted to an article pick-up means and each of said first and second cam tracks including arcuate portions engaged sequentially by respective ones of said first and second followers so that said article pick-up means is caused to move to an outwardly extended position and to an inwardly retracted position respectively, relative to a central axis of said cam plate and said cam assembly is characterised in that said article pick-up means is also caused to move through both a like-rotational and a counter-rotational path with regard to the direction of rotation of said drive means.

According to this aspect of the invention there is further provided a cam assembly further characterised in that said first and second cam track followers are joined by means of a cam arm to which is joined a second arm in superposed fixed relationship to said cam arm, and whereby said second arm comprises a bore adapted to carry a shaft which is able to rotate with respect to said second arm and where said shaft is connected to said article pick-up means and the rotational axis of the said shaft is displaced a greater distance from the central axis of the cam than either central axis of said first and second cam followers.

This aspect of the invention provides for a cam assembly which enables upward movement of an article pick-up means thus enabling a carton to be lifted out of a hopper prior to rotation through to a point where articles are fed into the carton. A cam assembly according to this aspect of the invention is therefore a great improvement over the prior art since more complex movement of both the pick-up means and carton is enabled thus allowing for greater flexibility in the design of carton hoppers used in this feeder mechanism as well as other associated features of the packaging machine. These improved features can be achieved whilst still providing or indeed improving the speed of operation of the paperfeed mechanism.

According to a further aspect of the invention there is provided a feeder mechanism comprising a cam assembly and a carton stowage wherein said carton pick-up means removes an article from said carton stowage during the counter-rotational movement of said pick-up means relative to the rotational movement of said drive means.

An embodiment of a cam assembly and feeder mechanism according to the invention will now be described, by way of example only, with reference to the accompanying drawings, in which.

Figure 1:
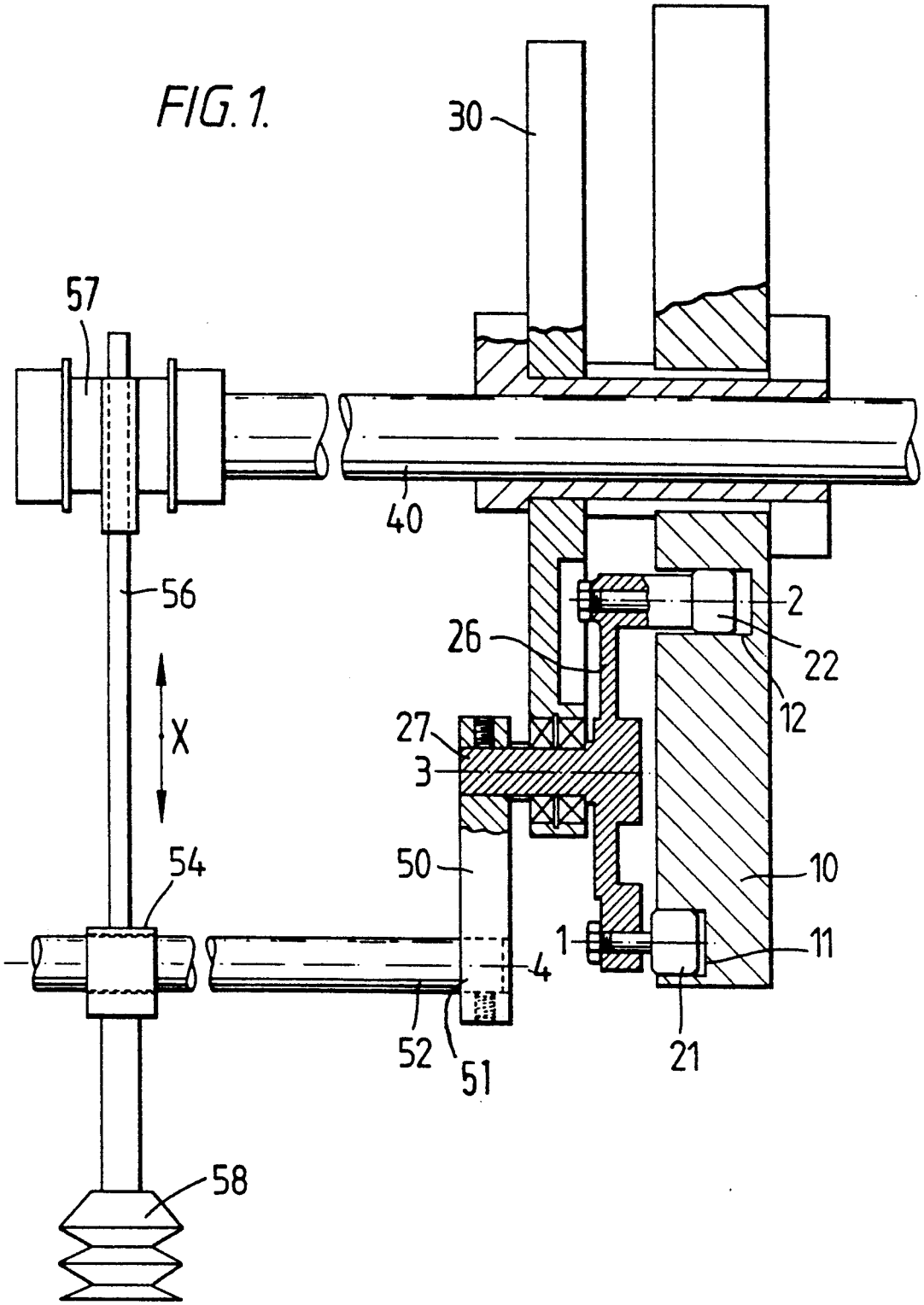
FIG. 1 shows a side elevation and partial cross-sectional view of a cam assembly according to the invention.
Figure 2:
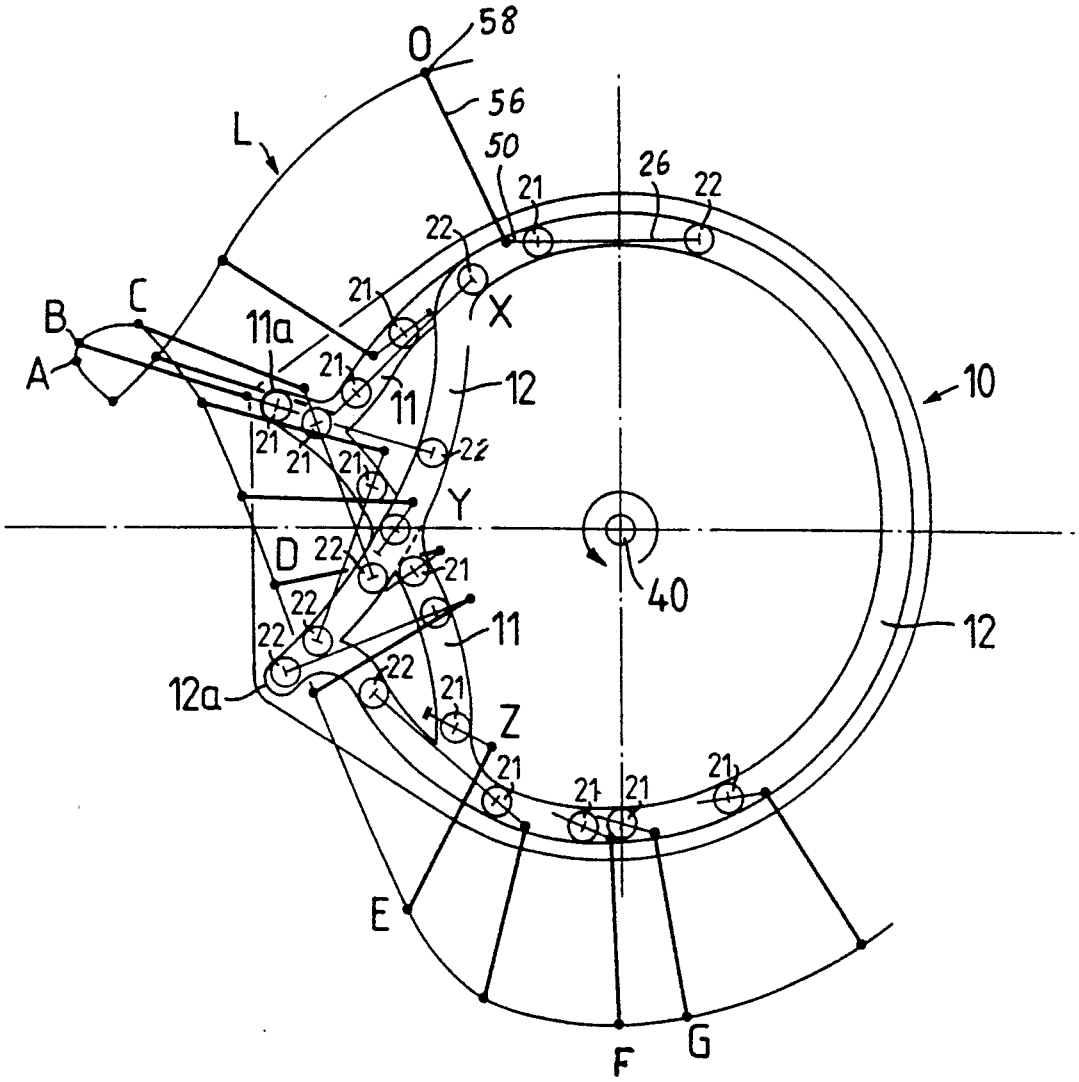
FIG. 2 shows an elevation view of a cam plate incorporated in the cam assembly according to the invention together with a schematic representation of the cam assembly during a feed cycle.

Referring to FIG. 1 a cam 10 is shown in partial cross-section revealing cam tracks 11 and 12. Cam track 11, is relatively shallower than cam track 12 and is adapted to receive only cam follower 21, as opposed to the axially longer cam follower 22. An elevation of the cam is shown in FIG. 2 where cam followers 21 and 22 are shown schematically at various points in their rotation about shaft 40. From FIG. 2 it can also be seen that cam track 12 is defined near the periphery of the cam 10, around most of the cam's circumference. However, at position X, the relatively shallower cam track diverges from cam track 12. The tracks intersect at position Y and cam track 12 is defined towards the periphery of the cam outside cam track 11. Both tracks merge at position Z.

Cam followers 21 and 22 are joined by means of an elongate cam arm 26. According to the specific embodiment shown in FIG. 1, the cam arm 26 comprises a cam shaft 27 which is rotatably journalled in disc 30 and keyed to arm 50. Wheel 30 is mounted for rotation upon main drive shaft 40 relative to cam 10. As wheel 30 drives cam arm 26 about shaft 40 relative to cam 10, cam followers 21 and 22 move in their predetermined paths and adopt the relative displacement indicated in FIG. 2.

Cam followers 21 and 22 are rotatable about axes 1 and 2 respectively in order to minimise friction and provide a better bearing during movement of cam arm 26. In this particular embodiment cam shaft 27 has a symmetry axis 3 which is centered between axes 1 and 2.

Cam arm 26 is further rigidly connected to arm 50 which is carried by a shaft 52. Shaft 52 is fixed in bore 51 of arm 50 at the opposite end of arm 50 to the fixing of cam shaft 27. The symmetry axis 4 of shaft 52 is displaced a greater distance from the central axis 3 of cam shaft 27 than the rotational axes 1 and 2 of cam followers 21 and 22 respectively. This greater displacement distance of axis 4 from axis 3 results in the small counter rotation movement of vacuum cup 58, (referred to below) during the uniform rotation of shaft 40 which drives the cam assembly. It is apparent that in similar embodiments of the invention the cam shaft 27 may not be centrally disposed on cam arm 26.

Shaft 52 is rotatably journalled in slider block 54, which is rigidly connected to rod 56 and pick-up 58. Rod 56 is slidably journalled in collar 57 which is rotatably mounted on, and not driven by, shaft 40. Collar 57 has a fixed axial position on shaft 40 but can rotate freely thereon. Shaft 40 drives wheel 30 which in turn drives cam arm 26, however, cam shaft 27 is rotatably journalled in wheel 30 and there is relative rotational movement of cam arm 26 with respect to wheel 30 as cam arm 26 moves round relatively fixed cam plate 10. In turn vacuum cup and block 54 rotate relative to cam arm 26 and shaft 52 and rod 56 is forced to slide relative to collar 57. The movement of cam arm 26 and other components is described in greater detail later, especially with reference to FIG. 2.

The vacuum cup 58 is linked to a vacuum generator (not shown) which is used to create a vacuum within the cup 58 so that the cup can attach to a carton and release the carton by decreasing and increasing the gas pressure in cup 58. By timing the vacuum generation means to create and quench the vacuum at specific times during the cam assembly rotation cycle a carton can be picked up and released at appropriate times.

Referring to FIG. 2 Position 0 is indicated which shows both cam track followers 21 and 22 in cam track 12 together with a schematic representation of cam arm 26, arm 50, rod 56 and the position of the vacuum cup 58. The path which the pick-up means, or vacuum cup 58, follows during the cycle of movement of the assembly is indicated by locus L along which seven further positions of these components are specifically labelled in FIG. 2 as positions A, B, C, D, E, F and G. The individual positions correspond to the sequence of movement of a carton from a hopper as shown in FIGS. 3 to 9 respectively.

Figure 3:
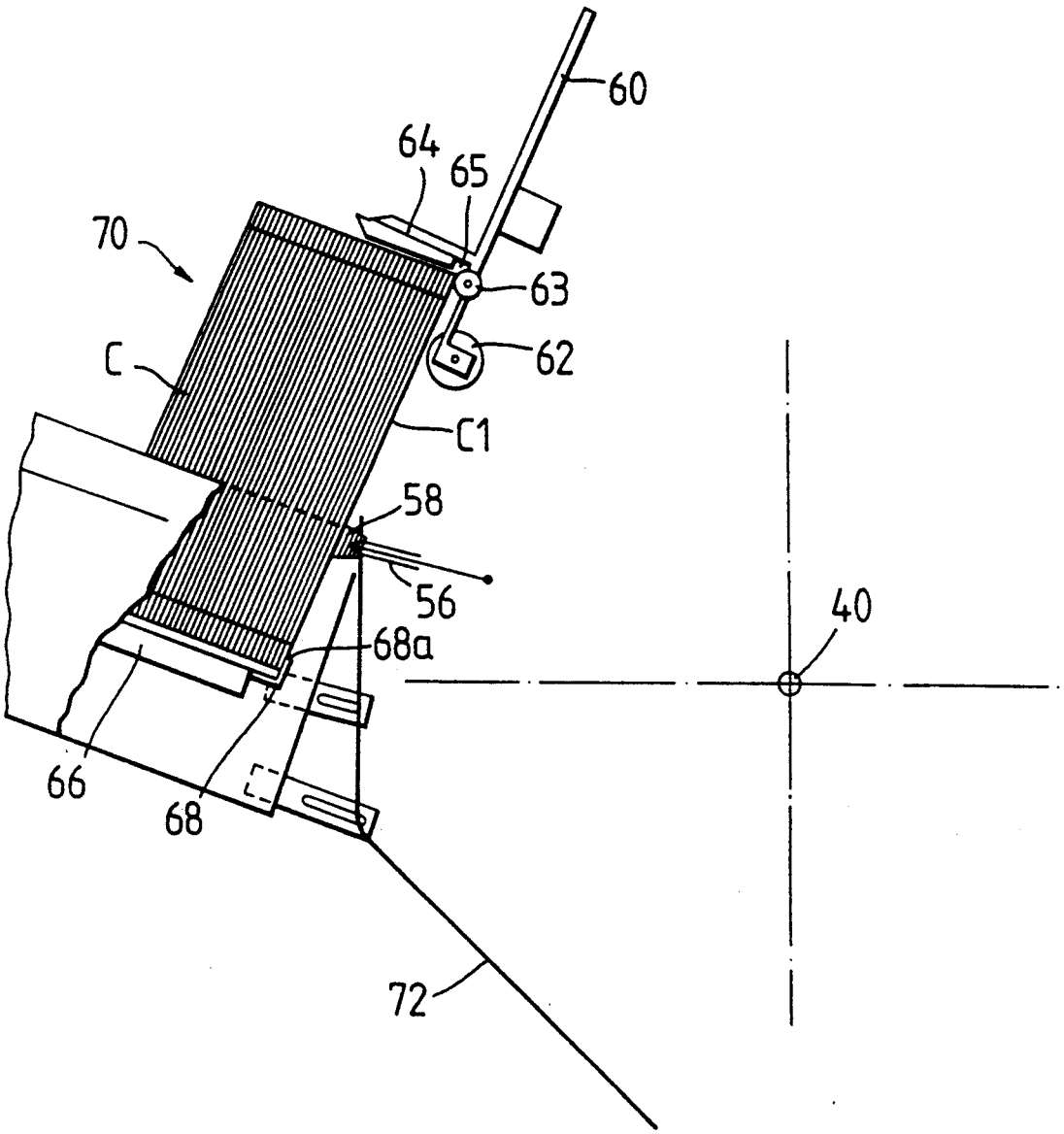
FIGS. 3 to 9 show a side elevation of a feeder mechanism as part of a packaging machine according to the invention at different times in the carton feed cycle.

Accordingly, FIG. 3 shows a side elevation view of a carton feeder mechanism which is part of an overall packaging machine. A collection of carton blanks C are held in a hopper 70 in a collapsed form prior to a first carton blank C1 being picked up using the vacuum cup 58 attached to rod 56 shown in FIG. 3. The hopper 70 comprises a base 66 and bottom carton retaining rim 68 both of which support the carton blanks and the rim assists in preventing the cartons from sliding forward out of the hopper. The cartons C are further retained by means of a paper feed retaining bracket 60 which comprises a wheel 62 and upper arm 64.

FIG. 3 corresponds to the feeder mechanism (and hence cam assembly) in position A indicated schematically in FIG. 2. This position of the cam assembly corresponds to cam follower 21 being located in recess **11*a* of cam track 11 as shown in FIG. 2. Cam follower 21 momentarily stays at position 11*a* while cam follower 22 sweeps through cam track 12 for part of its movement between points X and Y in cam 10. When the cam assembly is in this position the vacuum cup 58 is in an extended position relative to central shaft 40 as indicated at point A on the locus L. Thus, in FIG. 3 the rod 56 and cup 58 are shown in an extended position and cup 58** is engaged with carton C1.

Figure 4:
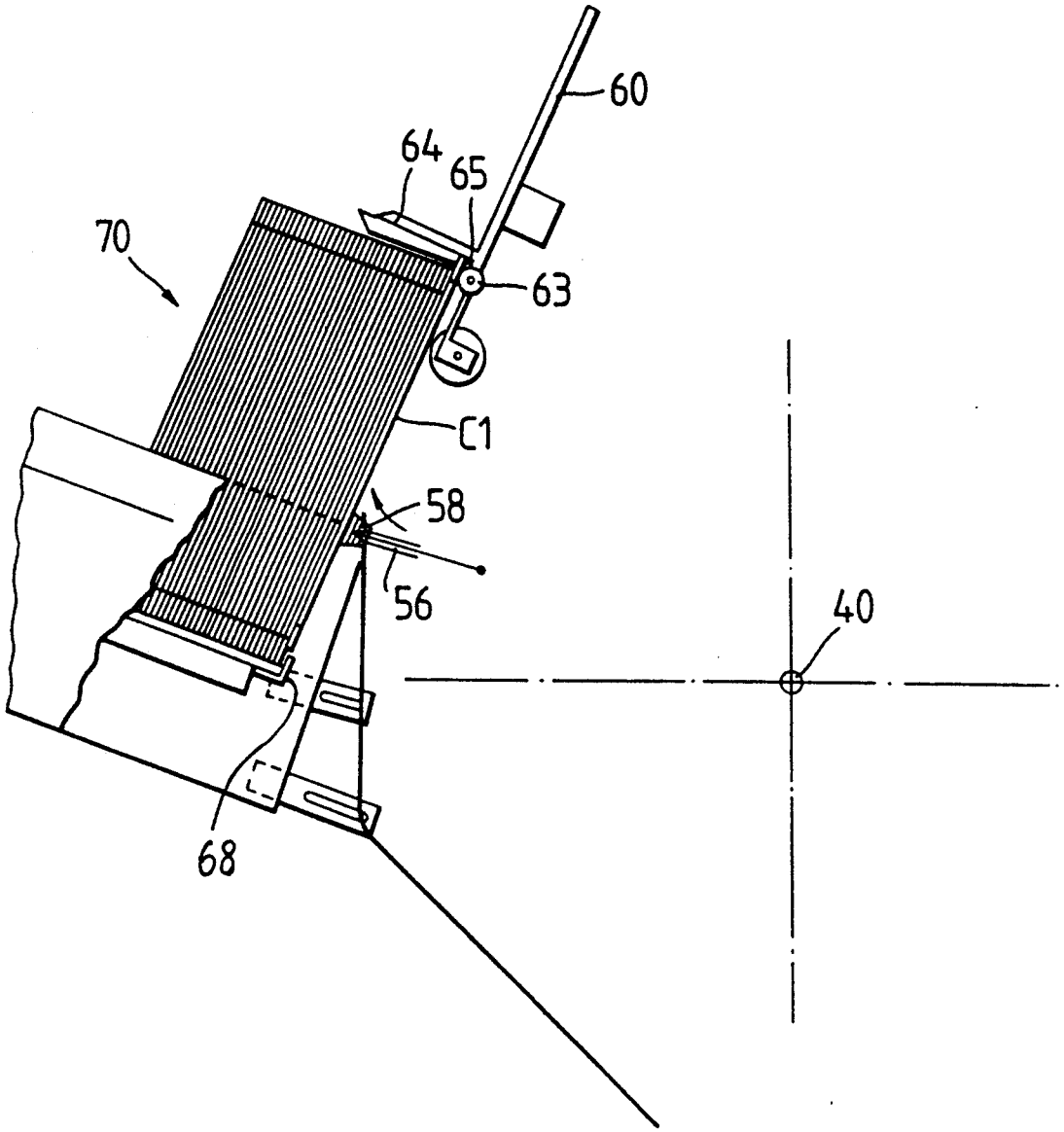
Figure 5:
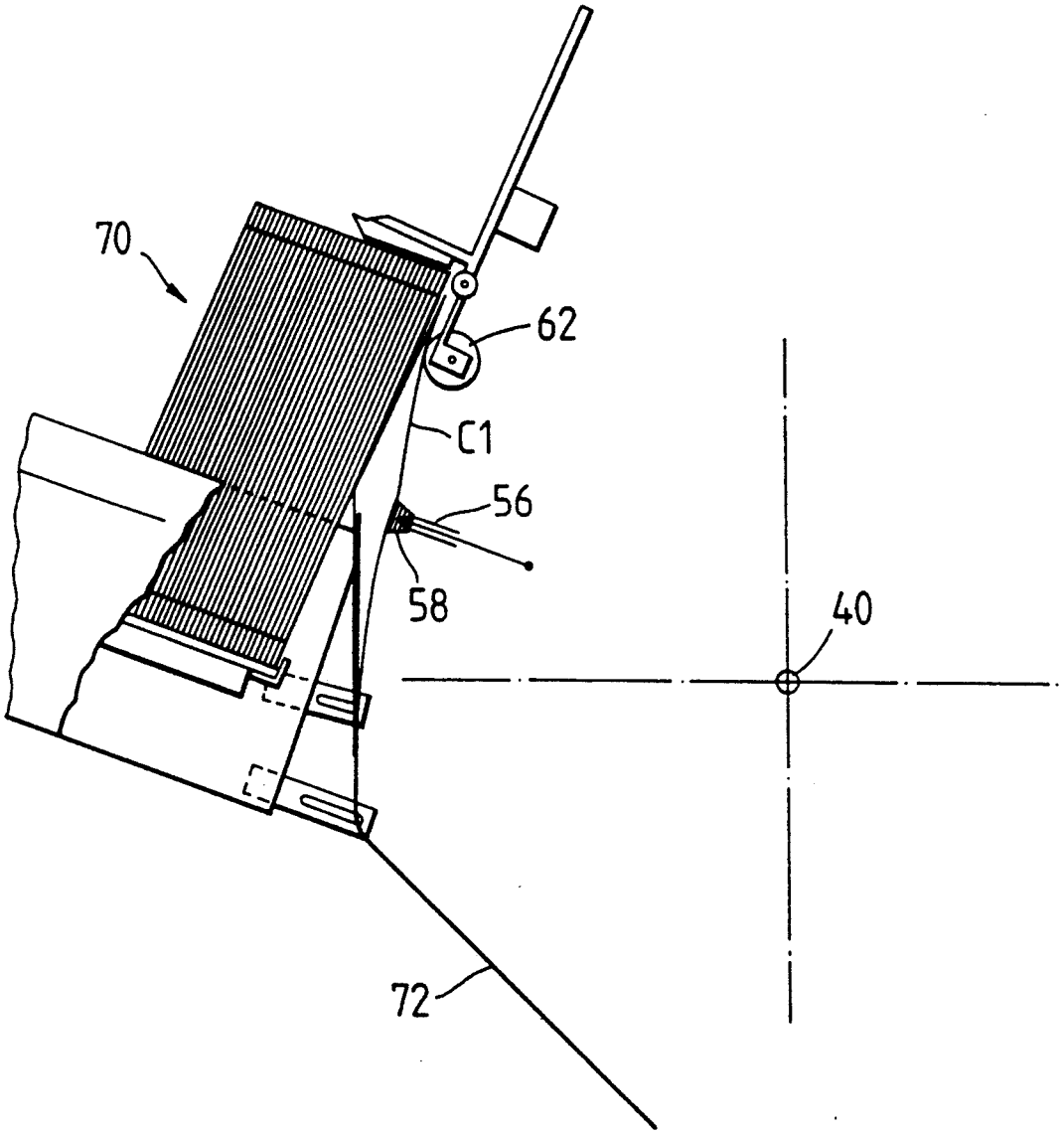
Figure 6:
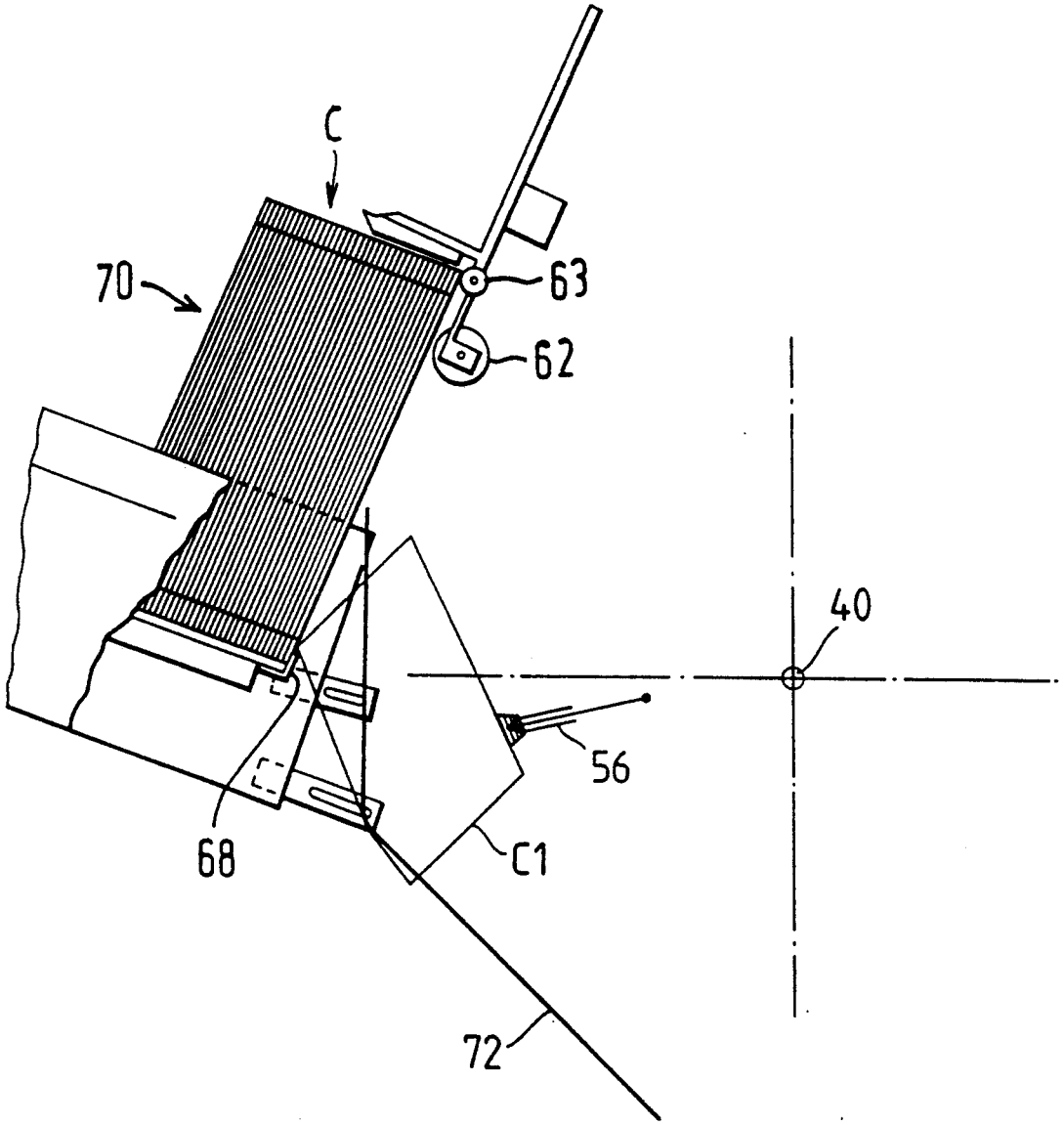
Figure 10:
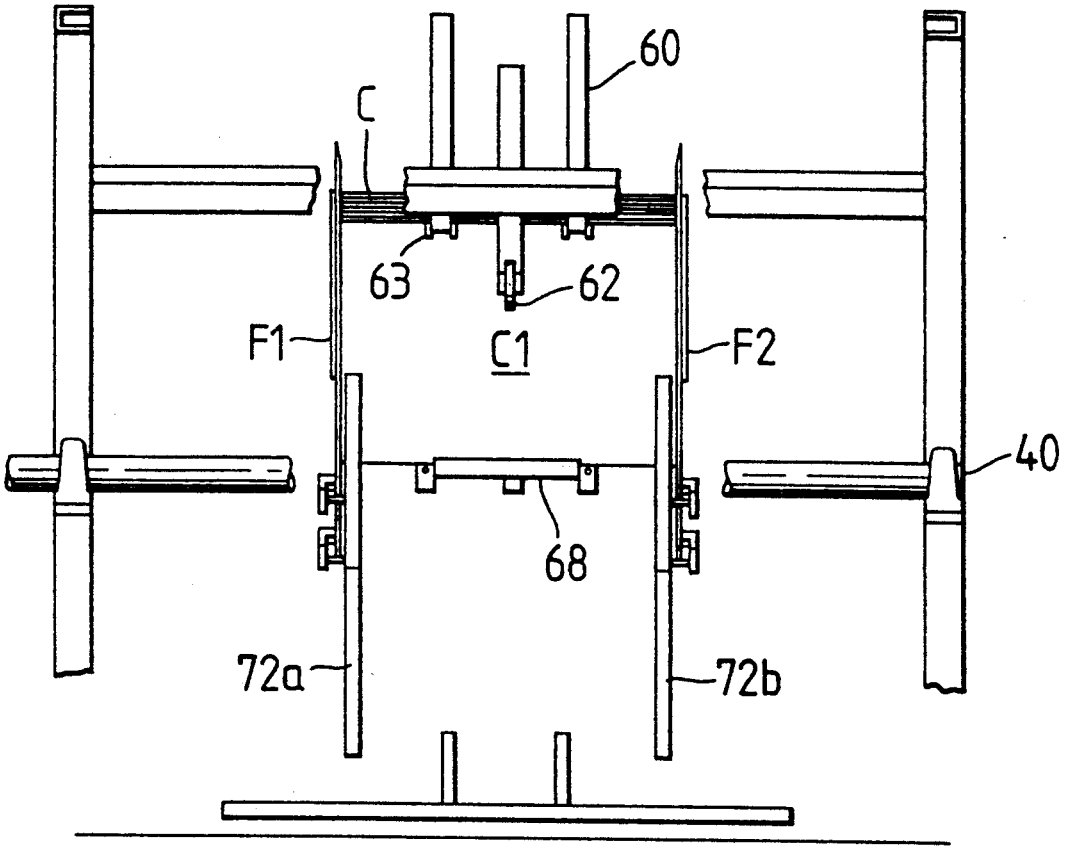
FIG. 10 shows a front elevation of part of the feeder mechanism.

FIG. 4 corresponds to the cam assembly at position B indicated in FIG. 2. In this position cup 58 is caused to counter rotate with respect to the otherwise anti-clockwise rotation of the cam assembly about shaft 40 thereby lifting the carton C1, the face of which lies substantially tangential to the counter rotational path of the cup, (see for example positions A and B of the locus described by the cup in FIG. 2). The carton is dislodged into recess 65 in the retaining bracket 60 by means of the action of the cup 58 and the guidance of boss 63, retaining rim 68 and the other cartons C in the hopper. Thus, a lifting action occurs between positions A and B of the cam assembly, when the cam assembly reaches position B carton C1 has been lifted clear of the upper edge **68*a* of retaining rim 68 whilst the other end of the carton abuts upper arm 64 of the retaining bracket 60. Further rotation of the cam assembly about shaft 40 causes cup 58 to move to position C which corresponds to the carton feeder assembly configuration shown in FIG. 5. It can be seen from FIG. 2 that cam track follower 21 has been withdrawn from recess 11*a* of cam track 11 and thus cup 58 is withdrawn from its outermost extended position. Correspondingly, in FIG. 5 carton C1 is shown being pulled out of the hopper 70 and in the initial stages of erection of the carton, a vacuum having been applied in the vacuum cup in order to pick up the carton C1. At about a time corresponding to position A indicated in FIG. 3, the vacuum cup is able to pull on the front panel of the carton blank C1. Wheel 62 and static guide 72 are used to assist in the formation of the carton into a sleeve. A front elevation of part of the packaging machine is shown in FIG. 10 where the hopper assembly can be seen to comprise a rearmost right and left flange F1 and F2 respectively. Wheel 62 acts to restrain the upper panels of the carton C1 as a front panel is withdrawn by cup 58** whilst flanges F1 and F2 engage end closure flaps of the carton associated with the rear main panels so that restraint also is provided to allow the required "opening" separation of the front panel away from the rear panels of the carton.

Position D of cup 58 on locus L shown in FIG. 2 corresponds to further rotation of the cam assembly whereby cam track follower 22 moves towards recess **12*a* in cam track 12 and therefore cup 58 is following its primary rotary path anti-clockwise about shaft 40. Carton C1 is therefore pulled downwards out of retaining contact with wheel 62 but still retained by static guides 72. Thus carton C1 is pulled clear of the hopper and remaining cartons C feed forward within the hopper due to gravity so that the next succeeding carton abuts boss 63 and retaining rim 68. It can be seen from FIG. 6** that carton C1 is almost fully formed into its tubular shape in which it can receive articles such as bottles or cans prior to completion of the carton around these articles.

Figure 7:
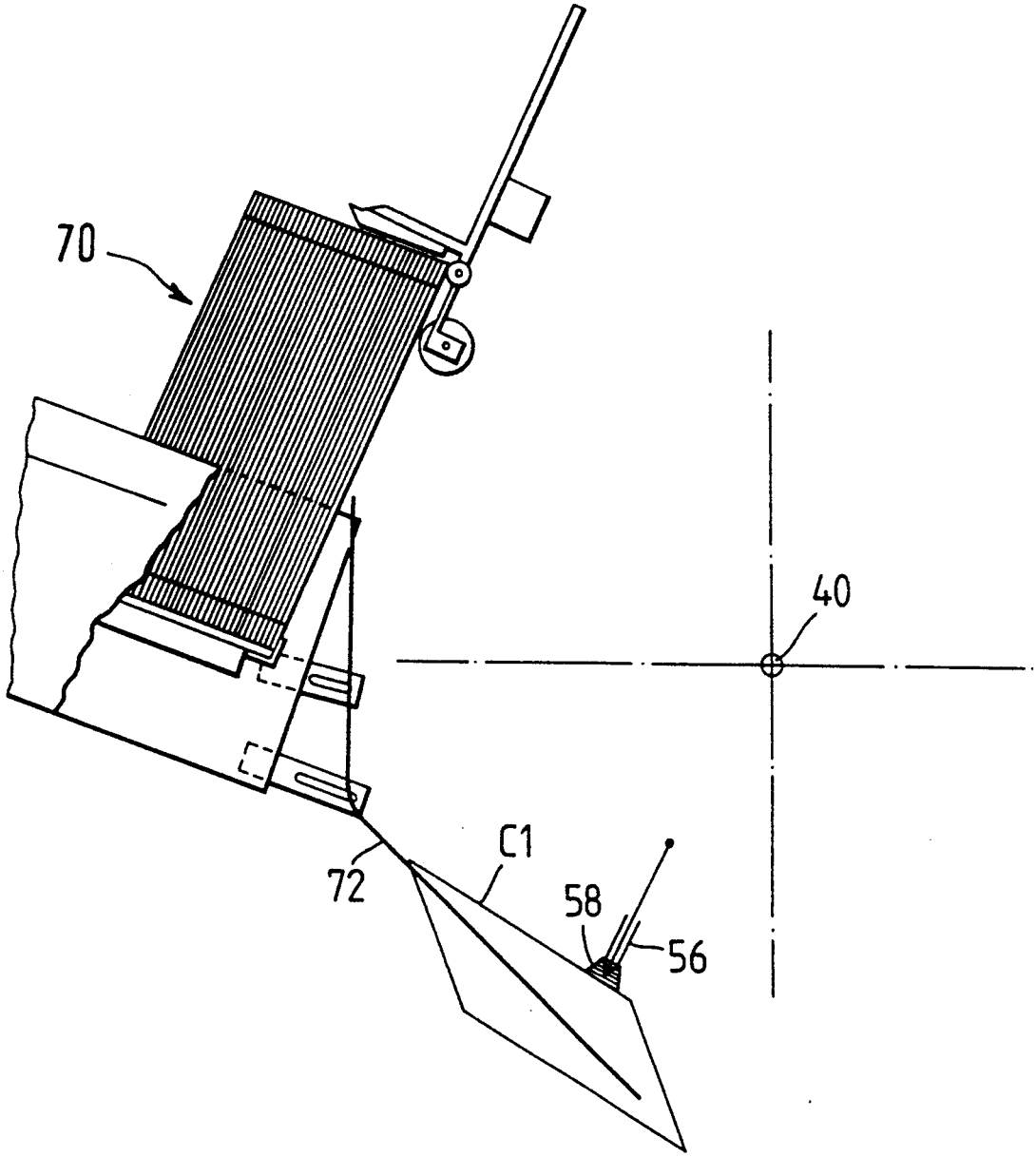
Figure 8:
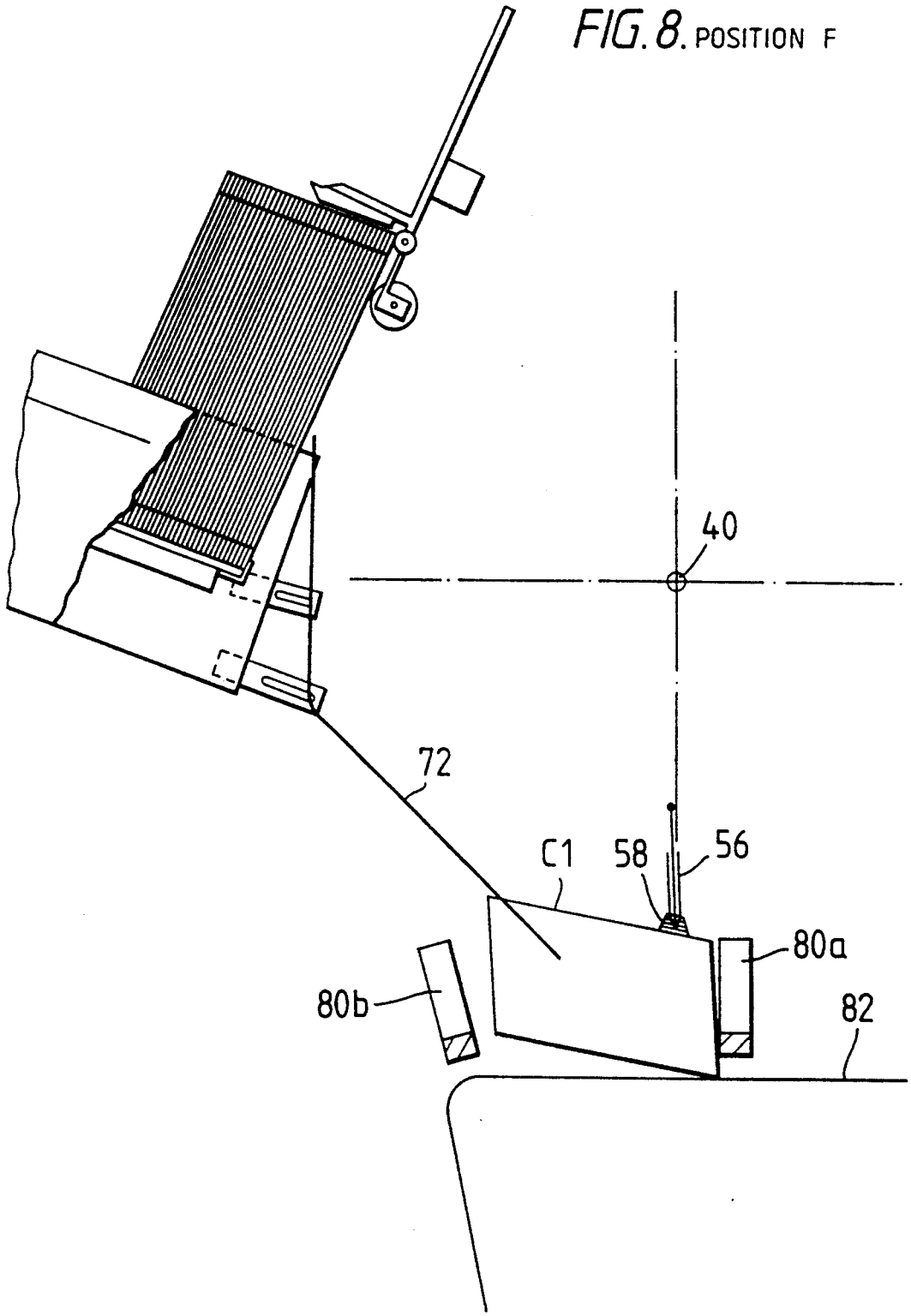
Figure 9:
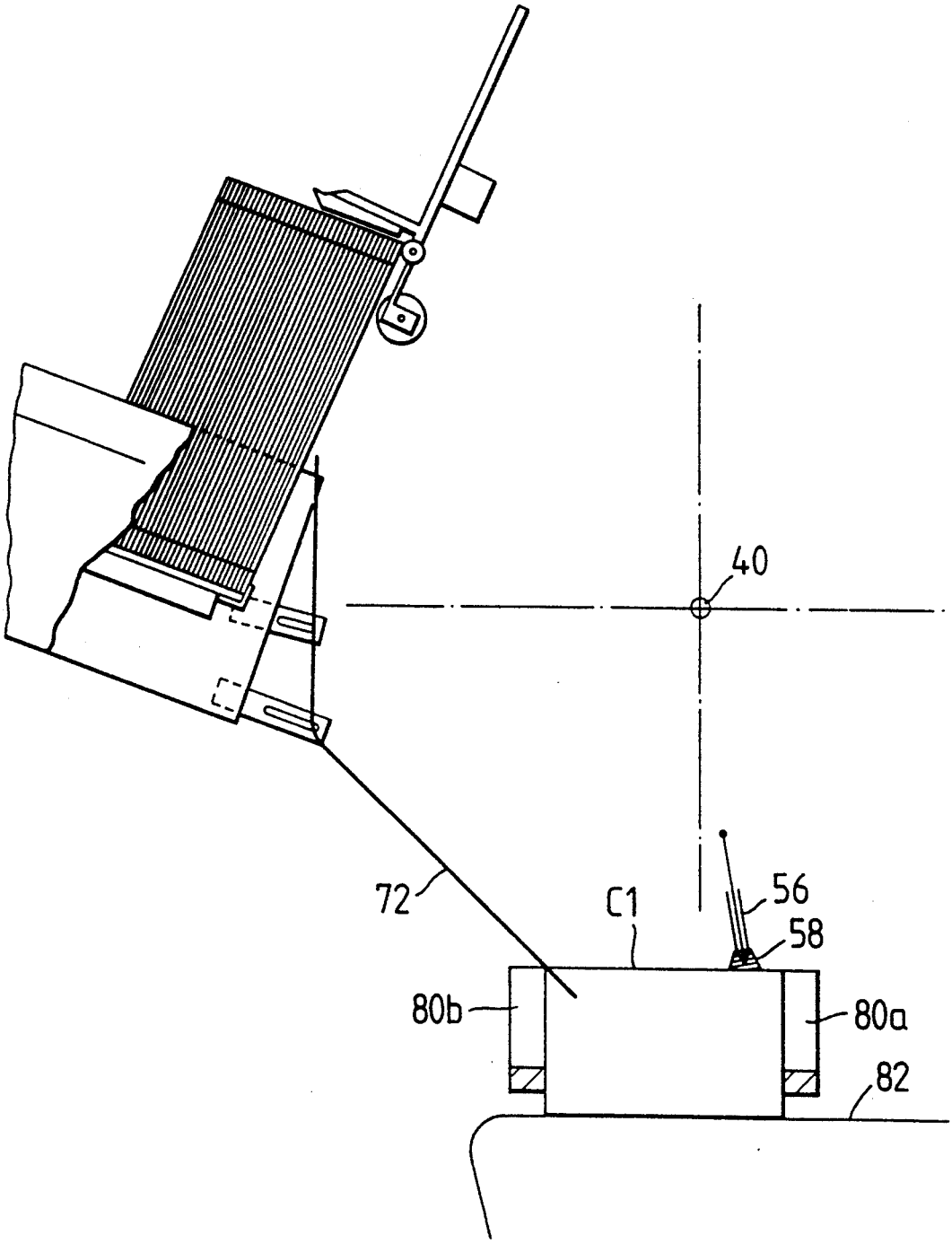

A further position in the process of withdrawing a carton from the hopper prior to its complete formation ready to receive articles is shown in FIG. 7. Here, cup 58 is shown at position E indicated in FIG. 2. Thus cup 58 continues its anti-clockwise rotation about shaft 40 thereby pulling carton C1 further away from hopper 70 and as shown in FIG. 7 carton C1 is still partly retained by static guide 72 and thereby maintained in partly erected position due to the opposite action of the vacuum cup 58 and static guide 72. FIGS. 8 and 9 show further rotation of the cam assembly where carton C1 is placed between flight bars 80*a* and 80*b* which draw carton C1 along a base 82, although base 82 may itself be a conveyor. FIG. 9 shows a fully erected carton in a sleeve form prior to suction cup 58 disengaging from the upper panel of the carton. FIGS. 8 and 9 correspond to positions F and G of suction cup 58 along the locus L shown in FIG. 2.

It is anticipated that by using several of the cam assemblies according to the invention a packaging machine may comprise multiple carton feeder assemblies comprising hoppers as specifically described herein and thereby enable high speed operation.

We claim:

1. A cam assembly for incorporation in an article feeder mechanism which assembly comprises a cam plate having formed therein a first continuous cam track and a second relatively shallower cam track, cam track follower means including a first follower for movement within said first continuous track and a second follower for movement within the first and second cam tracks, and drive means for moving said cam track followers with respect to said cam tracks, said cam track follower means being mounted to an article pick-up means, said first cam track including portions engaged sequentially by said first follower, and said second cam track including portions engaged sequentially by said second follower, whereby said article pick-up means is caused to move to an outwardly extended position and to an inwardly retracted position respectively, relative to a central axis of said cam plate and said cam assembly is characterized in that said first and second cam track followers are joined by means of a cam arm to which a second arm is joined in fixed relationship with said cam arm, said second arm carries a shaft rotatably connected to said article pick-up means, and a rotational axis of said shaft is displaced a greater distance from a central axis of said cam arm than wither central axis of said first and second followers whereby said article pick-up means is caused to move through both a like-rotational and a counter-rotational path with regard to the direction of rotation of said drive means.

2. A feeder mechanism comprising a cam assembly as claimed in claim 1 and an article stowage wherein said pick-up means removes an article from said stowage during the counter-rotational movement of said pick-up means relative to the rotational movement of said drive means.

3. A feeder mechanism as claimed in claim 2 wherein said stowage comprises a hopper for holding carton blanks in an unerected formation and wherein said hopper comprises a lowermost base for supporting the substantial part of the weight of the carton blanks which base comprising a retaining rim which protrudes from the lowermost edge of said base and onto which retaining rim a forward most carton abuts.

4. A feeder mechanism as claimed in claim 3 wherein said hopper further comprises an upper retaining bracket having a recess whose depth corresponds to at least the height of said retaining rim above said base such that when lifting a carton over said retaining rim, a part of the carton protrudes into said recess whereby the carton is allowed to clear said retaining rim.

* * * * *

UNITED STATES PATENT AND TRADEMARK OFFICE

CERTIFICATE OF CORRECTION

PATENT NO. : 5,249,916

DATED : October 5, 1993

INVENTOR(S) : Pascal Portrait, Michel Lamamy

It is certified that error appears in the above-identified patent and that said Letters Patent is hereby corrected as shown below:

Column 6, line 12, "wither" should read --either--.

Column 6, line 28, "comprising" should read --comprises--.

Signed and Sealed this

Sixteenth Day of April, 1996

Bruce Lehman

*Attest:*

BRUCE LEHMAN

*Attesting Officer*

*Commissioner of Patents and Trademarks*